United States Patent [19]

Rush

[11] Patent Number: 4,723,922

[45] Date of Patent: Feb. 9, 1988

[54] ELECTRICAL CONNECTORS AND CONNECTOR ELEMENTS

[75] Inventor: Derek A. Rush, London, England

[73] Assignee: Smiths Industries Public Limited Company, London, England

[21] Appl. No.: 11,943

[22] Filed: Feb. 6, 1987

[30] Foreign Application Priority Data

Feb. 7, 1986 [GB] United Kingdom ..... 8603134

[51] Int. Cl.[4] ..... H01R 13/05

[52] U.S. Cl. ..... 439/825

[58] Field of Search ..... 339/252 R, 252 P

[56] References Cited

U.S. PATENT DOCUMENTS 3,581,272 5/1971 Yopp ..... 339/252 P
3,924,921 12/1975 Feightner ..... 339/252 P

FOREIGN PATENT DOCUMENTS 244817 12/1925 United Kingdom .
251499 5/1926 United Kingdom .
299416 7/1929 United Kingdom .
398514 9/1933 United Kingdom .
463781 4/1937 United Kingdom .
1120358 7/1968 United Kingdom .

*Primary Examiner*—Joseph H. McGlynn
*Attorney, Agent, or Firm*—Pollock, VandeSande and Priddy

[57] ABSTRACT

An electrical connector pin for insertion into a socket of circular section is machined from a single piece of metal. The forward part of the pin has a constant cross-section along the major part of its length, being circular with two parallel flats which extend along its length. A slot extends across the forward part of the pin between opposite flats, dividing the pin into two prongs. The diameter of the socket is less than the diameter of the pin across its circular part but more than the width of the pin between the flats. In use, as the pin is inserted in the socket, it contacts the open end of the socket at four points between the flat and circular regions of the pin, gradually closing the slot at the tip until it is just open when inserted to its full extent.

7 Claims, 5 Drawing Figures

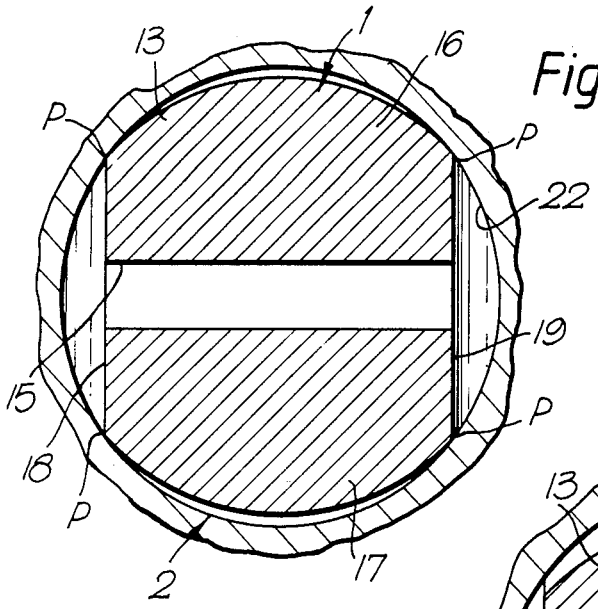
Fig. 3.
Fig. 4.
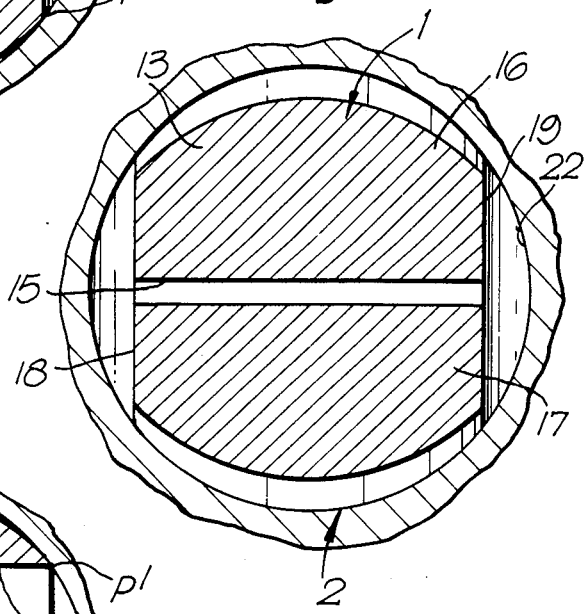
Fig. 5.
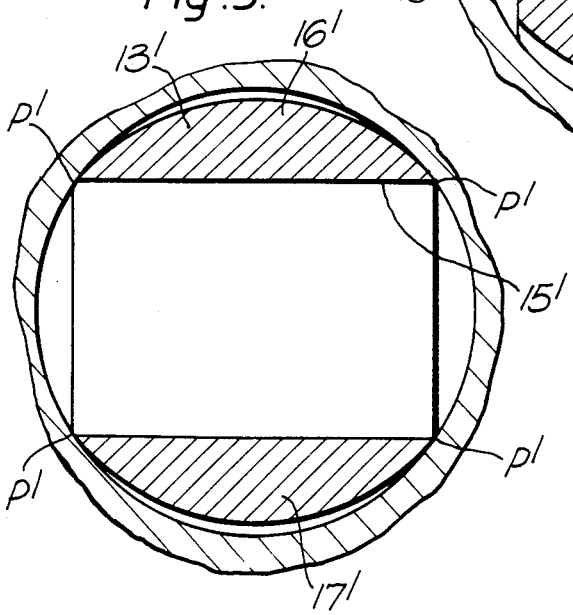

ELECTRICAL CONNECTORS AND CONNECTOR ELEMENTS

BACKGROUND OF THE INVENTION

This invention relates to electrical connectors and connector elements.

Conventional pin elements for electrical connectors are dimensioned and shaped to be a sliding fit within a female socket, which typically is a cylindrical sleeve of constant internal diameter and circular section. The pin elements are arranged to exert a resilient outward force on the internal surface of the socket so that good electrical connection is established. The pin elements are usually made smaller in diameter than the sleeve and are subsequently bowed outwardly at some point along their length so that a portion at least of the pin element is slightly larger than the sleeve. This subsequent process of bowing the pin is difficult to achieve with high accuracy. It is, however, important to control the dimensions of the pin accurately so that good electrical contact is achieved with the minimum insertion and withdrawal force. This is especially important in multipin connectors, which may include fifty or more pins, and in which the overall frictional force for insertion will be equal to the total of that of all the pins.

With previous pin elements, the points of contact between the pin element and the socket will be fixed relative to the pin element, but will be displaced along the socket as the pin is inserted. This can be a disadvantage where a plated socket is used, since it is progressively more difficult to plate the interior of a socket further from its opening. The best region of plating is close to the opening of the socket so it is desirable to confine contact to this region.

Some previous pin elements are formed from plate material which is cut to shape and subsequently rolled or bent to the required configuration. Such Pin elements are difficult to form with the accuracy needed for high performance connectors.

BRIEF SUMMARY OF THE INVENTION

According to one aspect of the present invention there is provided an electrical connector including a socket element of substantially circular internal section and a pin element with a forward portion insertable within the socket element, the forward portion having a substantially constant cross-section along a major part of its length and being generally circular in section apart from two regions that extend along opposite sides of the said major part, the diameter of the circular part of the forward portion being greater than the internal diameter of the socket element, a slot extending across the pin element between the two regions along at least said forward portion, and the overall width of the pin element across the width of the slot being reduced to less than the diameter of the socket element so as thereby to enable insertion of the pin element as a sliding contact in the socket element.

The two regions are preferably flattened sections extending along the forward portion, the width of the flattened sections being greater than the thickness of the slot. The flattened sections may be parallel flats.

Alternatively, the edges of the slot may provide the two regions, the thickness of the slot being such that the width of the pin element across the width of the slot is less than the diameter of the socket element.

The dimensions of the pin and socket element are preferably such that when the pin element is inserted to its full extent in the socket element the slot is just open at the forward tip of the pin element. The pin element is preferably a unitary construction made from a single piece of metal. The forward end of the pin element may have a rounded tip and the pin element may have a bore at its rear end adapted to receive an electrical conductor inserted therein. The pin element may be beryllium copper and may be plated.

According to another aspect of the present invention there is provided a a pin element for an electrical connector according to the above-mentioned one aspect of the invention.

According to a further aspect of the present invention there is provided a method of manufacture of a pin element for an electrical connector of the kind including a socket element of substantially circular internal section within which the pin element is insertable, comprising the steps of forming a forward portion of the pin element of substantially circular section and of diameter greater than the internal diameter of the socket element, forming a diametrical slot through the width of the pin element which opens at the forward end and extends along at least that length of the pin element insertable within the socket element, and forming two flattened regions along the pin element such as to reduce the width of the pin element across the width of the slot to less than the diameter of the socket element and thereby enable insertion of the pin element as a sliding contact in the socket element.

The method may include the step of forming a bore in the rear end of the pin element to receive an electrical conductor inserted therein. The pin element may be machined from a single piece of metal and the method may include the step of plating at least the forward portion of the pin element.

According to yet another aspect of the present invention there is provided a pin element made by a method according to the above-mentioned further aspect of the invention.

An electrical connector having a pin element, in accordance with the present invention will now be described, by way of example, with reference to the accompanying drawings.

BRIEF DESCRIPTION OF THE DRAWINGS

FIG. 3 is a transverse sectional view of the connector to an enlarged scale, along the line III—III of FIG. 1;

FIG. 4 is a transverse sectional view of the connector to an enlarged scale along the line IV—IV of FIG. 1; and FIG. 5 is a transverse section showing an alternative pin element for the connector.

DETAILED DESCRIPTION

Figure 1:
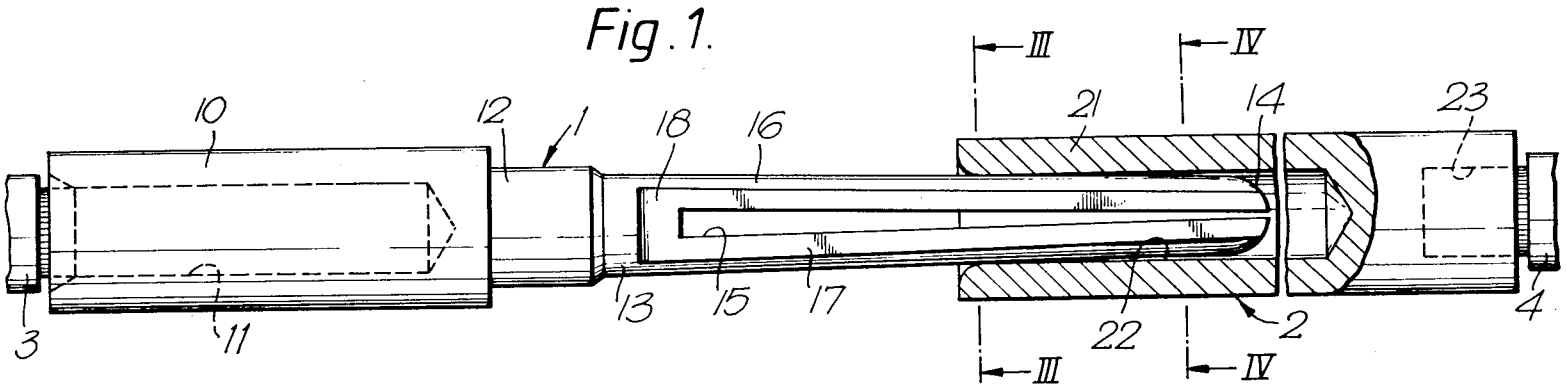
FIG. 1 is a side elevation view of the connector.
Figure 2:
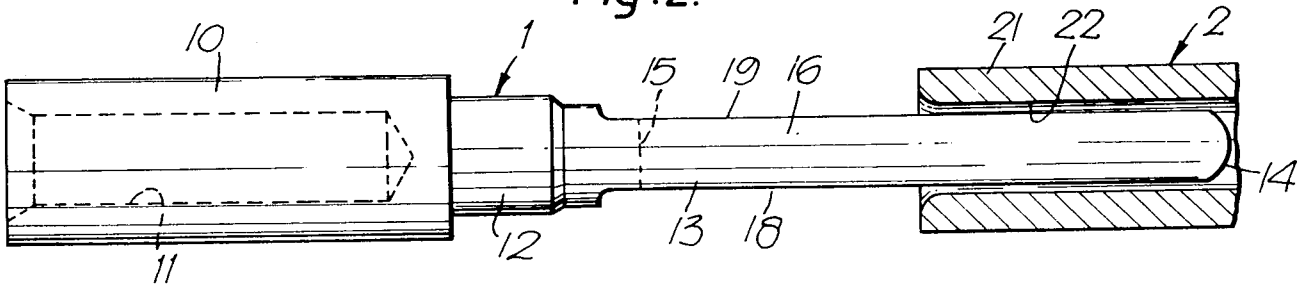
FIG. 2 is a plan view of the connector.

With reference to FIGS. 1 to 4, the electrical connector shown in the drawings is in two parts consisting of a pin element 1 and a socket element 2 into which the pin element can be inserted. The pin 1 and socket 2 are mounted in respective insulative housings (not shown) which serve to support other mating elements.

The pin 1 is a unitary construction machined from a single piece of half hard beryllium copper and is of generally cylindrical shape. The rear portion 10 of the pin element has an open axial bore 11 into which a wire 3 can be inserted and crimped or soldered to make electrical connection with the pin element. A short, solid intermediate portion 12 of smaller diameter separates the rear portion 10 from the forward portion 13.

The forward portion 13 provides that portion of the pin 1 which is insertable within the socket element 2. The forward portion is generally circular around its periphery, being 0.60 mm in diameter along its entire length apart from a hemispherical tip 14. Along the major part of the length of the forward portion 13 extends a diametrically disposed slot 15 which divides the forward portion into two parallel prongs 16 and 17 of generally sector shape. The slot 15 opens at the tip 14 of the pin and extends rearwardly for a distance greater than the length of the pin that is insertable in the socket 2, terminating just forwardly of the intermediate portion 12. The thickness of the slot 15 is 0.16 mm in its natural state, that is, before insertion in the socket.

Two parallel flats 18 and 19 extend along the length of the forward portion 13 from its tip 14 to a location to the rear of the rear end of the slot 15 and forwardly of the intermediate portion 12. The flats 18 and 19 are disposed along opposite edges of the two prongs 16 and 17, that is, along opposite edges of the slot 15 and extend laterally normally to the plane of the slot. The width of the pin element 1 across the width of the slot is reduced by the flats to 0.40 mm, the width of both flats being 0.45 mm.

The forward portion 13, at least, of the pin 1 is plated with a layer of gold to ensure a good electrical contact in the socket 2.

The socket element 2 is machined from a single piece of brass and is of cylindrical shape. One end 21 of the socket 2 is provided with an axial bore 22 that opens to receive the pin 1, the opening of the bore being flared to aid insertion. The diameter of the major part of the bore 22 is 0.57 mm, that is, smaller than the diameter of the curved part of the periphery of the forward portion 13 of the pin 1, but larger than the width of the pin across the flat part of its periphery. The other end of the socket 2 is formed with a bore 23 into which a wire 4 can be inserted and crimped or soldered to provide electrical connection with the socket 2.

The bore 22 of the socket 2 is plated with a layer of gold to ensure a good electrical contact with the pin 1. Because, however, of the difficulties of plating narrow cavities of this kind, the plating is of a higher quality close to the open end of the bore 22.

Since the diameter of the pin 1 is greater than of the bore 22 in the socket 2, on insertion, the slot 15 will be closed slightly, reducing the overall diameter of the pin to equal that of the socket. More particularly, the pin 1 will contact the inside of the socket 2 at four contact points P at the boundary of the flats 18 and 19 with the curved part of the surface of the pin. The points of contact P with the socket element 2 are located close to its open end and will remain there as the pin 1 is inserted further into the bore 22. As the pin 1 is pushed further into the socket 2, the slot 15 will gradually close at the tip 14. The dimensions of the pin 1 and socket 2 are selected such that the slot 15 will just remain open at the tip 14 when the pin is inserted to its full extent in the socket.

The function of the flats 18 and 19 is to provide two regions that reduce the width of the pin element 1 sufficiently for it to be inserted into a socket 2 which has a diameter less than that of the curved, circular periphery of the pin. The flats 18 and 19 need not have flat surfaces as described, but could be curved or otherwise profiled providing they act to reduce the width of the pin sufficiently for it to be inserted into the socket. Instead of providing flats as described, the thickness of the slot 15' could be increased, in the manner shown in FIG. 5, so that it is equal to the width of the flats 18 and 19 in the previous embodiment. In this way, the overall width of the forward portion 13' of the pin will be small enough to enable insertion to the socket. This arrangement, however, has the disadvantage of reducing the thickness of the two prongs 16' and 17' of the pin, thereby making the pin more prone to damage. The edges P' providing the points of contact with the socket will also be sharper than the previous arrangement. This makes the edges more liable to damage and wear, and may cause increased wear to the socket.

The pin element 1 can be readily made by machining from a solid cylindrical rod having a diameter equal to that of the rear portion 10. The external diameter of the rod is reduced by machining to produce the intermediate and forward portions 12 and 13. The bore 11 at the rear end of the pin, and the rounded tip at the forward end can then be machined. Subsequently, the slot 15 and flats 18 and 19 can be machined away, such as by milling or sawing, the sharp edges to the flats of the pin then being broken, such as by rumbling or etching. These operations can be carried out to high accuracy readily by automated machines thereby enabling pin elements to be produced which have accurately controlled dimensions. This enables pin elements to be produced which have a low insertion force yet provide a good electrical contact and long life. Following the machining operations the pin element is cleaned and gold plated in the usual way.

What I claim is:

1. An electrical connector comprising a socket element having a substantially circular internal section and an open end, and a pin element having a forward portion with a substantially constant cross section along a major part of its length, the said major part of said pin element being of generally cylindrical shape and circular section and having two flattened regions extending along the length of the cylindrical part on diametrically opposite sides thereof, the diameter of said forward portion across a circular part of its section being greater than the internal diameter of said socket element and the width of said forward portion between the two flattened regions being less than the internal diameter of said socket element, said pin element having a slot extending diametrically across it between the two flattened regions, and said slot extending along at least the said forward portion and opening at the forward end of the pin element so as to divide the forward portion of said pin element into two prongs, said two prongs extending parallel to one another before insertion into the socket element and being deflected towards one another at their forward end as the pin element is inserted into the socket element such that said pin element makes sliding contact with said socket element in the region of its open end only by edges between said flattened regions and the adjacent curved part of the forward portion of said pin element.

2. An electrical connector according to claim 1, wherein the dimensions of the said pin element and the said socket element are selected such that the said slot is just open at the forward end of the pin element when the pin element is inserted to its full extent in the socket element.

3. An electrical connector according to claim 1, wherein the said pin element is a unitary construction made from a single piece of metal.

4. An electrical connector according to claim 1, wherein the said pin element has a rounded tip at its forward end.

5. An electrical connector according to claim 1, wherein the said pin element has a bore therein at its rear end and wherein the said bore is adapted to receive an electrical conductor inserted therein.

6. A method of manufacture of a pin element for an electrical connector of the kind including a socket element of substantially circular internal section having an open end into which the pin element is insertable, the method comprising the steps of: forming a forward portion of the pin element of circular section and constant diameter greater than the internal diameter of the socket element, forming a diametrical slot through the width of the pin element which opens at the forward end of the pin element and extends along at least that length of the pin element insertable within the socket element so as to divide the forward portion of the pin element into the two prongs that extend parallel to one another before their insertion into the socket element, and forming two flattened regions extending along opposite sides of the said slot such as to reduce the width of the pin element across the width of the slot to less than the diameter of the socket element and thereby enable insertion of the pin element into the open end of the socket element as a sliding contact made with the socket element in the region of its open end only by edges between said flattened regions and the curved part of the forward portion of the pin element and such that the prongs are deflected towards one another at their forward end as the pin element is inserted into the socket element.

7. A method of manufacture according to claim 6, wherein the pin element is machined from a single piece of metal.

* * * * *